US008770456B2

(12) United States Patent
Moeller et al.

(10) Patent No.: US 8,770,456 B2
(45) Date of Patent: Jul. 8, 2014

(54) RECHARGE CYCLE FUNCTION FOR COMBUSTION NAILER

(75) Inventors: Larry Moeller, Schaumburg, IL (US); Frederic Nayrac, F-Bourg les Valences (FR); Hanxin Zhao, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1483 days.

(21) Appl. No.: 13/058,087

(22) PCT Filed: Nov. 17, 2006

(86) PCT No.: PCT/US2006/044578

§ 371 (c)(1),
(2), (4) Date: May 10, 2011

(87) PCT Pub. No.: WO2008/048294

PCT Pub. Date: Apr. 24, 2008

(65) Prior Publication Data

US 2011/0204118 A1 Aug. 25, 2011

Related U.S. Application Data

(60) Provisional application No. 60/852,039, filed on Oct. 16, 2006.

(51) Int. Cl.
*B25C 1/08* (2006.01)

(52) U.S. Cl.
USPC ..... 227/2; 227/8; 227/10

(58) Field of Classification Search
USPC ..... 227/2, 8, 9, 10, 130; 123/46 SC
See application file for complete search history.

(56) References Cited

U.S. PATENT DOCUMENTS

| | | | |
|---|---|---|---|
| 4,403,722 | A | 9/1983 | Nikolich |
| 4,483,473 | A | 11/1984 | Wagdy |
| 4,483,474 | A | 11/1984 | Nikolich |
| 4,522,162 | A | 6/1985 | Nikolich |
| RE32,452 | E | 7/1987 | Nikolich |
| 4,717,060 | A | 1/1988 | Cotta |
| 4,721,240 | A | 1/1988 | Cotta |
| 5,133,329 | A | 7/1992 | Rodseth et al. |
| 5,197,646 | A | 3/1993 | Nikolich |
| 5,213,247 | A | 5/1993 | Gschwend et al. |
| 5,263,439 | A | 11/1993 | Doherty et al. |
| 5,592,580 | A | 1/1997 | Doherty et al. |
| 5,713,313 | A | 2/1998 | Berry |
| 5,909,836 | A | 6/1999 | Shkolnikov et al. |
| 6,116,489 | A | 9/2000 | Branston |
| 6,123,241 | A | 9/2000 | Walter et al. |
| 6,145,724 | A | 11/2000 | Shkonikov et al. |
| 6,425,354 | B1 | 7/2002 | Büchel et al. |
| 6,460,507 | B2 | 10/2002 | Thieleke et al. |
| 6,526,926 | B1 | 3/2003 | Towfigh |

(Continued)

*Primary Examiner* — Scott A. Smith
(74) *Attorney, Agent, or Firm* — Greer, Burns & Crain, Ltd.; Maurice E. Finnegan, III; Mark W. Croll

(57) ABSTRACT

A combustion nailer includes a tool housing, and a combustion engine substantially located within the housing and including a valve sleeve reciprocating relative to a cylinder head for cyclically opening and closing a combustion chamber. A control system is associated with the housing and is connected to the combustion engine for providing for a designated open time for the combustion chamber after a combustion event and before a subsequent combustion can occur.

16 Claims, 5 Drawing Sheets

(56) References Cited

U.S. PATENT DOCUMENTS

| | | | | |
|---|---|---|---|---|
| 6,532,917 | B2 | 3/2003 | Thieleke et al. | |
| 6,666,366 | B2 | 12/2003 | Rosenbaum et al. | |
| 6,695,195 | B2 | 2/2004 | Nishikawa et al. | |
| 6,715,655 | B1 | 4/2004 | Taylor et al. | |
| 6,722,550 | B1 | 4/2004 | Ricordi et al. | |
| 6,783,042 | B2 | 8/2004 | Kaufer | |
| 6,783,045 | B2 | 8/2004 | Shima et al. | |
| 6,826,935 | B2 | 12/2004 | Gokcebay et al. | |
| 6,842,401 | B2 | 1/2005 | Chiang et al. | |
| 6,886,730 | B2 | 5/2005 | Fujisawa | |
| 6,889,885 | B2 | 5/2005 | Ohmori | |
| 6,971,568 | B2 | 12/2005 | Schiestl et al. | |
| 6,983,871 | B2 | 1/2006 | Shima et al. | |
| 7,021,251 | B2 | 4/2006 | Ohmori et al. | |
| 7,040,261 | B2 * | 5/2006 | Granacher et al. | 123/46 SC |
| 7,108,164 | B2 | 9/2006 | Shima et al. | |
| 7,163,134 | B2 | 1/2007 | Moeller et al. | |
| 7,341,171 | B2 * | 3/2008 | Moeller et al. | 227/8 |
| 7,510,105 | B2 * | 3/2009 | Moeller et al. | 227/8 |
| 7,673,779 | B2 * | 3/2010 | Moeller et al. | 227/10 |
| 8,070,031 | B2 * | 12/2011 | Moeller et al. | 227/2 |
| 8,215,528 | B2 * | 7/2012 | Matsunaga et al. | 227/8 |
| 8,261,847 | B2 * | 9/2012 | Ford et al. | 173/1 |
| 8,336,749 | B2 * | 12/2012 | Largo | 227/10 |
| 2005/0091962 | A1 | 5/2005 | Van Erden et al. | |
| 2005/0173484 | A1 | 8/2005 | Moeller et al. | |
| 2005/0173485 | A1 | 8/2005 | Moeller | |
| 2005/0247749 | A1 | 11/2005 | Wywialowski et al. | |
| 2006/0102111 | A1 | 5/2006 | Ohmori et al. | |
| 2007/0034659 | A1 | 2/2007 | Moeller et al. | |
| 2007/0131731 | A1 | 6/2007 | Moeller et al. | |

* cited by examiner

RECHARGE CYCLE FUNCTION FOR COMBUSTION NAILER

RELATED APPLICATION

This application claims priority pursuant to 35 USC §120 based on U.S. Ser. No. 60/852,039 filed Oct. 16, 2006.

TECHNICAL FIELD

The present invention relates generally to fastener-driving tools used to drive fasteners into workpieces, and specifically to combustion-powered fastener-driving tools, also referred to as combustion tools or combustion nailers.

BACKGROUND

Combustion nailers are known in the art, and are described in U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar tools are available commercially from Illinois Tool Works of Glenview, Ill.

Such tools incorporate a tool housing enclosing a small internal combustion engine or power source. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber; turbulence for increasing the combustion process; scavenging combustion by-products with fresh air; and cooling the engine. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures created by cooling of residual combustion gases within the combustion engine. Fasteners are fed magazine-style into the nosepiece, where they are held in a properly positioned orientation for receiving the impact of the driver blade.

After the combustion cycle, also known as the power cycle, is completed, it is followed by an exhaust cycle and thereafter a recharge cycle. During the recharge cycle, the valve sleeve is in the open venting position and the fan motor replaces spent combustion gases with fresh air. For effective and repeatable nailer performance, it is necessary that the recharge cycle has been completed before a subsequent cycle occurs. If spent gases have not been entirely or substantially removed, then during the subsequent operation cycle, combustion will not occur or will be insufficient. This is the result of improper fuel to air ratio caused by exhaust gases diluting the fresh air charge.

Traditionally, combustion-powered tools have been designated as sequentially operated. In other words, the tool must be pressed against the work, collapsing the workpiece contact element (WCE) before the trigger is pulled for the tool to fire or drive a nail. This contrasts with pneumatic tools, which can be fired or activated in a repetitive cycle operational format. In other words, the latter tools will fire repeatedly by pressing the tool against the workpiece, if the trigger is held in the depressed mode. These differences manifest themselves in the number of fasteners that can be fired per second for each style tool and for each mode of operation. Another aspect of sequential operation of combustion nailers is that only after a valve sleeve position switch, commonly referred to as a "chamber switch" and a trigger switch have been closed in the order mentioned and then opened, will a subsequent engine cycle be permitted. Such an operational control, described in U.S. Pat. No. 5,133,329, incorporated by reference, prevents unwanted ignition or other tool feature operations, such as electronic fuel injection (EFI), in instances when both switches remain closed after an engine cycle is complete.

It is known to provide a combustion nailer with the user-controlled option of operation in either sequential or repetitive cycle mode. Such operation is described in co-pending U.S. patent application Ser. No. 11/028,450 filed Jan. 3, 2005, US Patent Application Publication 2005/0173487A1 which is incorporated by reference. To achieve successful operation in the repetitive cycle mode, the tool's valve sleeve must be automatically controlled to maintain a correct combustion sequence in the face of increased firing cycles.

However, in repetitive cycle operation, the control system in some cases may authorize a subsequent ignition even if there has been inadequate opportunity for a satisfactory recharge cycle. Thus, while electronically "authorized", an actual combustion will not occur, since the combustion chamber gases have not been adequately exchanged or replaced. Subsequently, unwanted operation of the ignition system, EFI or other tool functions may occur, wasting tool resources and possibly shortening tool operational life.

U.S. Pat. No. 6,783,045 discloses a combustion-powered nail gun designed for either sequential or repetitive cycle operation. Included in this device when in repetitive cycle ("successive shot") operation, is a successive shot timer which is triggered upon ignition. The successive shot timer allots a period of time Td2 after ignition during which a successive ignition is prevented. Functions of the period Td2 are for allowing time for the piston to drive a fastener and return to the prefiring position, and also for allowing for the exhaust gas in the combustion chamber to be replaced with fresh air. The '045 patent recognizes that if ignition is permitted prior to the expiration of Td2, a failed ignition may result.

However, despite the allotment of time Td2, it is likely that a user operating the tool at a rapid rate will lift the nailer quickly from one site of a fastener application, opening the combustion chamber quickly but insufficiently to effectively replace the exhaust gas with fresh air. The user then progresses to the next fastening site and presses the tool against the workpiece so that the combustion chamber is sealed for the next engine combustion cycle. Since the combustion chamber was not effectively recharged with fresh air, the subsequent combustion cycle and fastener drive will be ineffective, thereby wasting fuel, battery power, and possibly spoiling the work piece. It will be seen that merely allocating a period of time after ignition for the recharging of combustion chamber gas will not ensure that the recharge has taken place.

Thus, there is a need for an improved control system for a combustion nailer, wherein the control system prevents tool operation unless the recharge cycle is completed, regardless of whether the tool is in a repetitive or a sequential operational mode. There is also a need for an improved control system for a combustion nailer that conserves tool power resources unless desired conditions are present for subsequent engine combustion cycles. Additionally, there is a need for improved valve sleeve position monitoring to assure the recharge cycle is complete.

SUMMARY

The above-listed needs are met or exceeded by the present recharge cycle monitor for combustion nailers which overcomes the limitations of the current technology. A portable combustion nailer provides the user with the ability to operate in repetitive firing mode and features a control system which improves battery life, increases component life, and reduces wasted fuel. The above-identified improvements are achieved through a control system designed to assure a completed recharge cycle prior to a subsequent combustion. This improvement is preferably obtained through the monitoring of ventilation time, or the "open time" of the chamber switch, which is an indicator of the time needed for a proper recharging of combustion chamber gases.

More specifically, a combustion nailer includes a tool housing, and a combustion engine substantially located within the housing and including a valve sleeve reciprocating relative to a cylinder head for cyclically opening and closing a combustion chamber. A control system is associated with the housing and is connected to the combustion engine for providing for a designated open time for the combustion chamber after a combustion event and before a subsequent combustion can occur.

In another embodiment, a combustion nailer includes a tool housing, a combustion engine substantially located within the housing, a valve sleeve reciprocating relative to a cylinder head for cyclically opening and closing a combustion chamber, and a chamber switch associated with the combustion engine and configured for being activated by the reciprocating movement of the valve sleeve. A control system is associated with the housing and is connected to the chamber switch for providing for a designated open time for the chamber switch after a combustion event and before a subsequent combustion can occur.

In still another embodiment, a combustion nailer includes a tool housing, a combustion engine substantially located within the housing and including a valve sleeve reciprocating relative to a cylinder head for cyclically opening and closing a combustion chamber. A chamber switch is associated with the combustion engine and is configured for being activated by the reciprocating movement of the valve sleeve. A supplemental chamber status sensor is associated with the combustion engine and is disposed relative to the valve sleeve to detect open and sealed positions of the combustion chamber.

DETAILED DESCRIPTION

Figure 1:
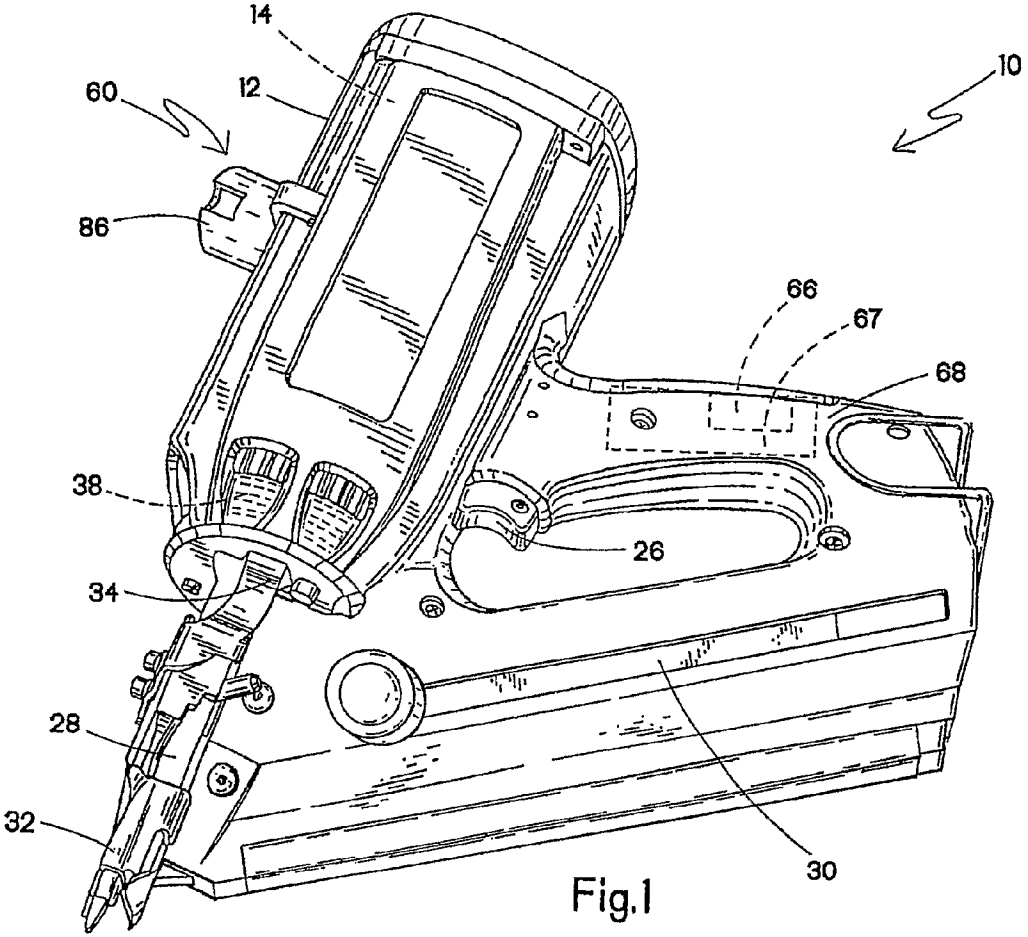
FIG. 1 is a front perspective view of a combustion nailer incorporating the present control system.
Figure 2:
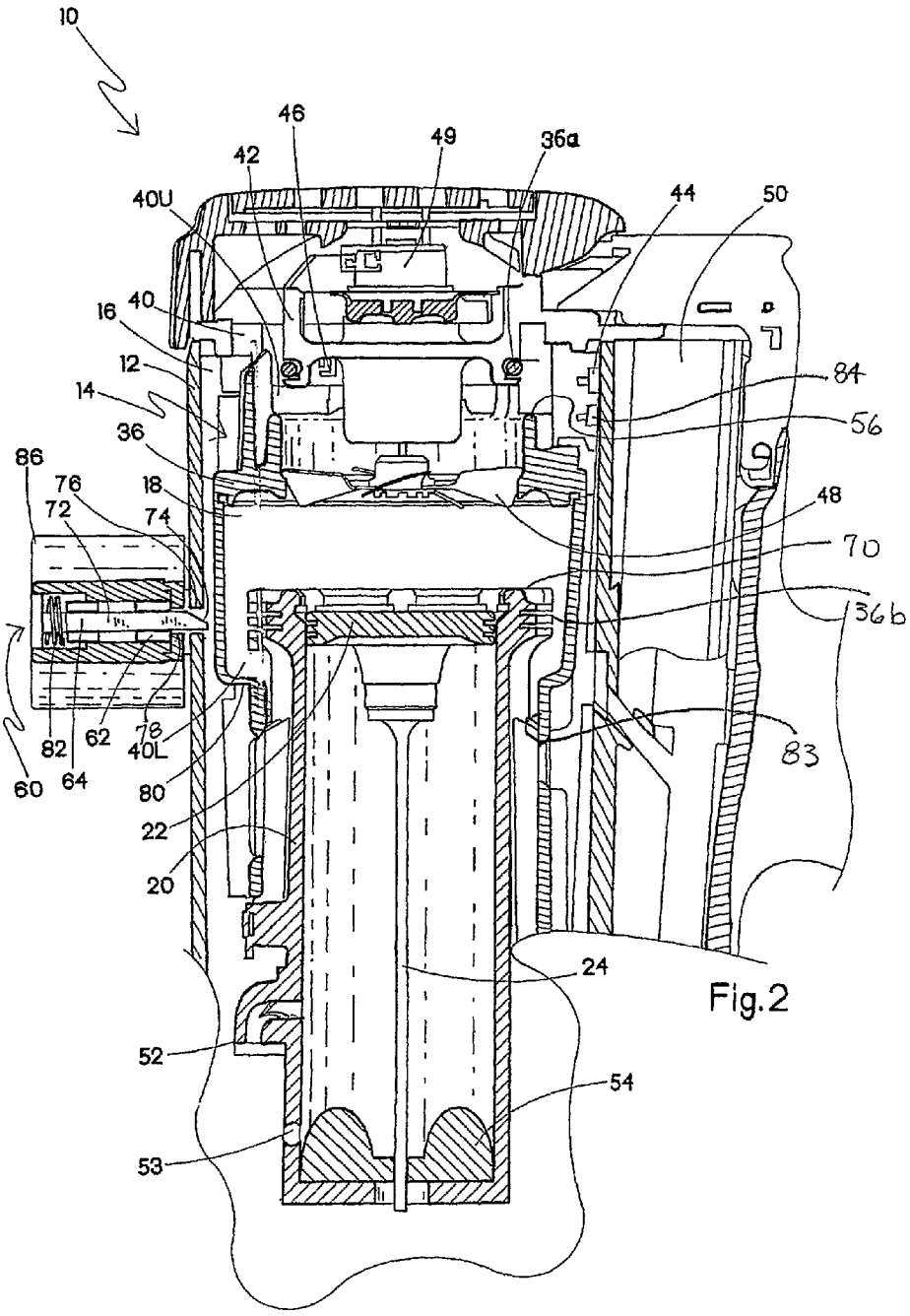
FIG. 2 is a fragmentary vertical cross-section of the tool of FIG. 1 shown in the rest position.

Referring now to FIGS. 1 and 2, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 2, an upper limit of the reciprocal travel of the piston 22 is referred to as a pre-firing position, which occurs just prior to firing, or the ignition of the combustion gases which initiates the downward driving of the driver blade 24 to impact a fastener (not shown) to drive it into a workpiece.

Through depression of a trigger 26 and actuation of an associated trigger switch (not shown, the terms trigger and trigger switch are used interchangeably), a user induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Included in the nosepiece 28 is a workpiece contact element 32, which is connected, through a linkage or upper probe 34 to a reciprocating valve sleeve 36, which partially defines the combustion chamber 18. Depression of the tool housing 12 against a workpiece (not shown) in a downward direction as seen in FIG. 1 (other operational orientations are contemplated as are known in the art), causes the workpiece contact element to move relative to the tool housing 12 from a rest position to a firing position. This movement overcomes the normally downward biased orientation of the workpiece contact element 32 caused by a spring 38 (shown hidden in FIG. 1). It is contemplated that the location of the spring 38 may vary to suit the application, and locations displaced farther from the nosepiece 28 are envisioned.

Through the linkage 34, the workpiece contact element 32 is connected to, or in contact with, and reciprocally moves with, the valve sleeve 36. In the rest position (FIG. 2), the combustion chamber 18 is not sealed, since there is an annular gap 40 including an upper gap 40U separating the valve sleeve 36 and a cylinder head 42, which accommodates a spark plug 46, and a lower gap 40L separating the valve sleeve and the cylinder 20. A chamber switch 44 is located in proximity to the valve sleeve 36 to monitor its positioning. In the present tool 10, the cylinder head 42 also is the mounting point for a cooling fan 48 and a fan motor 49 powering the cooling fan. In the rest position depicted in FIG. 2, the tool 10 is disabled from firing because the combustion chamber 18 is not sealed at the top with the cylinder head 42, and the chamber switch 44 is open.

Under sequential operation, firing is enabled when a user presses the nosepiece 28 and the workpiece contact element 32 against a workpiece. The sliding action of the workpiece contact element 32 relative to the nosepiece 28 overcomes the biasing force of the spring 38, causes the valve sleeve 36 to move upward relative to the housing 12, closing the gaps 40U and 40L and sealing the combustion chamber 18 until the chamber switch 44 is activated. An upper end of the valve sleeve 36 actually over travels or moves past a seal 36*a* which is preferably an O-ring but other types of sliding seals are contemplated. This operation also induces a measured amount of fuel to be released into the combustion chamber 18 from a fuel canister 50 (shown in fragment), or optionally through an electronically controlled fuel valve.

Upon pulling the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder, it pushes a rush of air which is exhausted through at least one petal or check valve 52 and at least one vent hole 53 located beyond piston displacement (FIG. 2). At the bottom of the piston stroke or the maximum piston travel distance, the piston 22 impacts a resilient bumper 54 as is known in the art. With the piston 22 beyond the exhaust check valve 52, high pressure gasses vent from the cylinder 20 until near atmospheric pressure conditions are obtained and the check valve 52 closes. Due to internal pressure differentials in the cylinder 20, the piston 22 is returned to the pre-firing position shown in FIG. 2.

As described above, one of the issues confronting designers of combustion-powered tools of this type is the need for a rapid return of the piston 22 to pre-firing position and improved control of the chamber 18 prior to the next cycle. This need is especially critical if the tool is to be fired in a repetitive cycle mode, where an ignition occurs each time the workpiece contact element 32 is retracted, and during which time the trigger 26 is continually held in the pulled or squeezed position, and the actual ignition is activated by closing of the chamber switch 44.

Referring now to FIG. 2, to accommodate these design concerns, the present tool 10 preferably incorporates a chamber lockout device, generally designated 60 and configured for preventing the reciprocation of the valve sleeve 36 from the closed or firing position until the piston 22 returns to the pre-firing position. While discussed generally below, the lockout device 60 is disclosed in greater detail in co-pending U.S. application Ser. No. 11/028,432, filed Jan. 3, 2005, US Patent Application Publication 2005/0173484A1 which is incorporated by reference. This holding, delaying or locking function of the lockout device 60 is operational for a specified period of time required for the piston 22 to return to the pre-firing position. Thus, the user using the tool 10 in a repetitive cycle mode can lift the tool from the workpiece where a fastener was just driven, and begin to reposition the tool for the next firing cycle.

Due to the shorter firing cycle times inherent with repetitive cycle operation, the lockout device 60 ensures that the combustion chamber 18 will remain sealed, and the differential gas pressures maintained so that the piston 22 will be returned before a premature opening of the chamber 18, which would normally interrupt piston return. With the present lockout device 60, the piston 22 return and subsequent opening of the combustion chamber 18 can occur while the tool 10 is being moved toward the next workpiece location.

More specifically, and while other types of lockout devices are contemplated and are disclosed in the co-pending application Ser. No. 11/028,432 incorporated by reference, the exemplary lockout device 60 includes an electromagnet 62 configured for engaging a sliding cam or latch 64 which transversely reciprocates relative to valve sleeve 36 for preventing the movement of the valve sleeve 36 for a specified amount of time. This time period is controlled by a control circuit, system or program 66 (FIG. 1) embodied in a central processing unit or control module 67 (shown hidden), typically a microprocessor housed in a handle portion 68 (FIG. 1) or other location in the housing 12, as is well known in the art. While other orientations are contemplated, in the depicted embodiment, the electromagnet 62 is coupled with the sliding latch 64 such that the axis of the electromagnet's coil and the latch is transverse to the driving motion of the tool 10. The lockout device 60 is mounted in operational relationship to an upper portion 70 of the cylinder 20 so that sliding legs or cams 72 of the latch 64 having angled ends 74 pass through apertures 76 in a mounting bracket 78 and the housing 12 to engage a recess or shoulder 80 in the valve sleeve 36 once it has reached the firing position. The latch 64 is biased to the locked position by a spring 82 and is retained by the electromagnet 62 for a specified time interval.

For the proper operation of the lockout device 60, the control system 66 is configured so that the electromagnet 62 is energized for the proper period of time to allow the piston 22 to return to the pre-firing position subsequent to firing. More specifically, when the control system 66, triggered by an operational sequence of switches (not shown) indicates that conditions are satisfactory to deliver a spark to the combustion chamber 18, the electromagnet 62 is energized by the control program 66 for approximately 100 msec. During this event, the latch 64 is held in position, thereby preventing the chamber 18 from opening. The period of time of energization of the electromagnet 62 would be such that enough dwell is provided to satisfy all operating conditions for full piston return. This period may vary to suit the application.

The control system 66 is configured so that once the piston 22 has returned to the pre-firing position; the electromagnet 62 is de-energized and via sliding latch 64, the spring 38 will overcome the force of the spring 82, and any residual force of the electromagnet 62, and will cause the valve sleeve 36 to move to the rest or extended position, opening up the combustion chamber 18 and the gaps 40U, 40L. This movement is facilitated by the shoulder 80 of the valve sleeve 36 acting on the cammed surfaces 74 of the legs 72, thereby retracting the sliding latch 64. As is known, the valve sleeve 36 must be moved away from the fan 48 to open the chamber 18 for exchanging gases in the combustion chamber and preparing for the next combustion.

Figure 3:
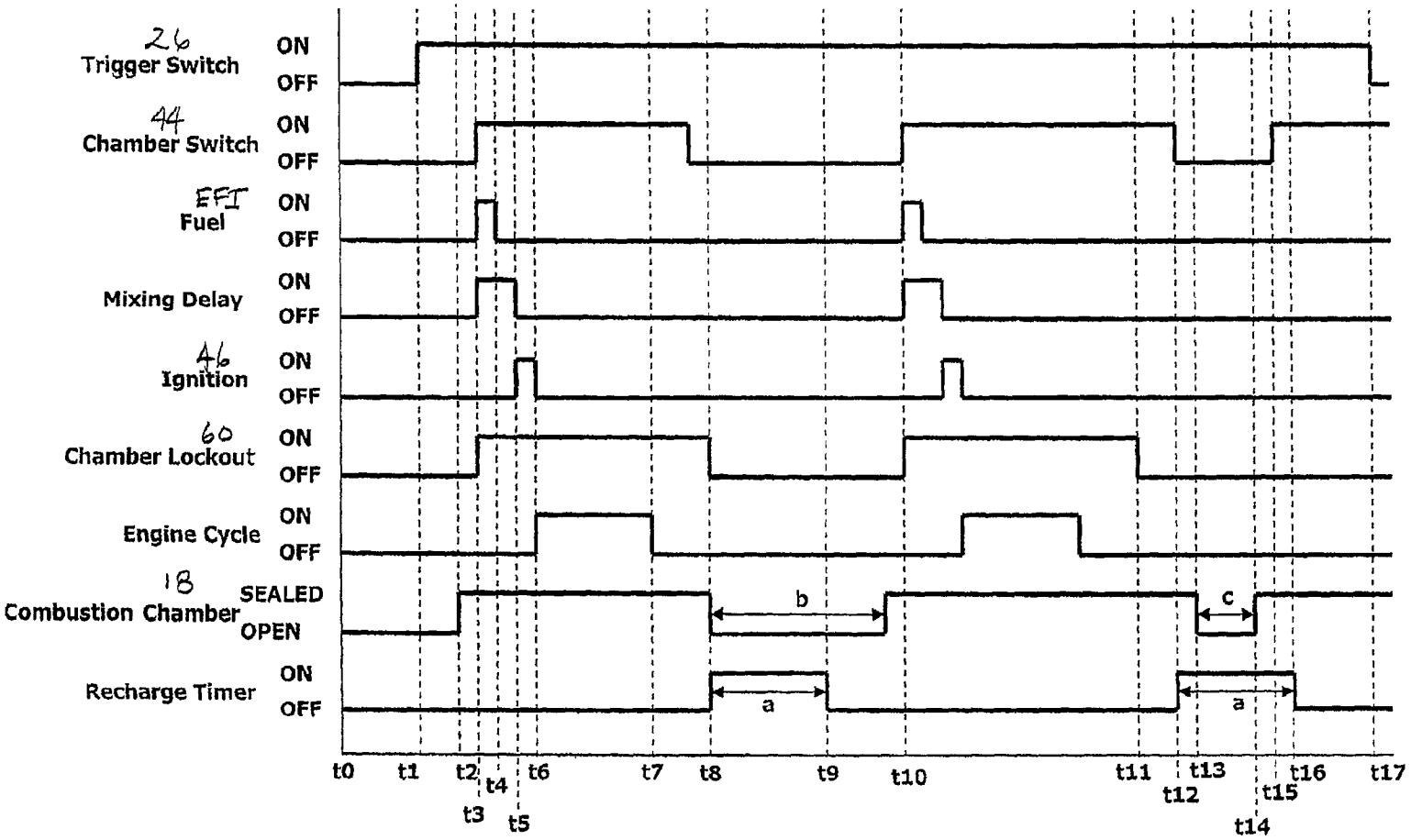
FIG. 3 is a control system timing chart illustrating the nailer operational phases of the trigger switch, chamber switch, fuel mixing delay, ignition, chamber lockout, engine cycle, combustion chamber position and recharge timer in a fastener nailer incorporating the present control system and used for repetitive firing.

Referring now to FIG. 3, which represents a schematic view of the operational sequence as programmed into the control system 66, in the repetitive cycle mode of operation, the user typically holds the trigger 26 and its associated switch closed, and fastener-driving combustion events are generated by operation of the chamber switch 44. At time t0, the tool 10 is at rest pre-firing. All switches and functions are off. When the user needs to drive a fastener in repetitive cycle mode, the tool 10 is picked up, the user selects the repetitive cycle mode and subsequently closes the trigger switch 26 at t1 to initiate the engine cycle. As is indicated in FIG. 3, the trigger 26 remains pulled through repetitive firings, as is known in the art as customary with repetitive cycle operation. According to the control system 66, the fan 48 is then energized for circulating air in the combustion chamber 18.

The tool 10 is then placed against the workpiece until the valve sleeve 36 moves upward relative to the cylinder head 42, eventually closing the combustion chamber 18 at t2 and ultimately closing the chamber switch 44 at t3. The gap between t2 and t3 represents the over travel of the valve sleeve 36 relative to the cylinder head 42. More specifically, as the workpiece contact element 32 moves relative to the nosepiece 28, an upper edge 56 of the valve sleeve 36 sealingly contacts the combustion chamber seal 36*a* and a corresponding lower edge 83 of the valve sleeve 36 contacts seal 36*b* prior to the actuation of the chamber switch 44. Thus, the valve sleeve 36 continues to move relative to the cylinder head 42 after the combustion chamber 18 is sealed; and before the tool 10 is properly seated upon the workpiece prior to firing. Simultaneously, the fuel metering valve (represented by FUEL in FIG. 3) is an electronic valve or EFI, injects a dose of fuel into the combustion chamber 18, which is mixed by, the rotating fan 48, and the lockout device 60 is energized to retain the valve sleeve 36 in the closed position during and post combustion for a specified period of time. Also at t3, an ignition delay or Mixing Delay is initiated to permit the rotating fan 48 to mix the fuel/air mixture in the combustion chamber.

Next, at t4, the EFI completes the injection of fuel into the combustion chamber 18. It will be seen that the Mixing Delay of t3 continues until t5 to provide sufficient time for the air/fuel mixture to fully disperse within the combustion chamber 18. Also at t5, the control system 66 initiates the ignition cycle and energizes the spark plug 46 and thus initiates combustion at t6. The trigger switch 26, and the chamber switch 44 remain closed during this period, and the combustion chamber 18 remains sealed.

Between t6 and t7 the combustion engine 14 runs through its cycle of driving a fastener, exhausting the exhaust gas through the petal valve 52 and returning the piston 22 to the prefiring position (FIG. 2). Due to the inherent over travel of the tool, at t8, as the user lifts the tool 10 from the workpiece, there is a certain amount of slidable play in the valve sleeve 36 relative to the cylinder head 42 allowed by the lockout device 60. Thus, the chamber switch 44 opens between t7 and t8, prior to the release of the lockout device 60 and the ultimate opening of the combustion chamber 18. To ensure sufficient time for the piston 22 to return to the prefiring position, the lockout device 60 remains energized for a predetermined time until t8.

At t8, the open position of the combustion chamber 18 is detected and compared to a recharge timer of approximately 50-100 msec duration, or whatever designated minimum open time period is considered appropriate by the designer for ensuring that an adequate recharge of gases has occurred, with approximately 50 msec being preferred. Furthermore, at t8, the detection of combustion chamber 18 to be open and its comparison to the recharge timer is initiated at the moment when the lockout device 60 is turned OFF, which closely approximates when the combustion chamber is in the open position.

In some tool operating scenarios the combustion chamber 18 open position is detected by the opening of the chamber switch 44, but in the current tool operating scenario in FIG. 3, the lockout device 60 is used since it is possible for the chamber switch 44 to be open while the combustion chamber 18 is still sealed by the lockout device. This can occur during tool recoil or rapid positioning of the tool 10 by the user. In such situations, the chamber switch 44 is not a clear indicator of the open status of the combustion chamber 18. Thus, the minimum monitoring period, or designated open time, begins after the chamber switch 44 is open and the lockout device 60 is released, or optionally whichever occurs later.

The vent time is based on air flow of cubic feet per minute (CFM) and combustion chamber size. The higher the air flow rate, the less time to vent and recharge the combustion chamber 18. The smaller the chamber 18, the less time is required to vent. It is preferred that the volume of the combustion chamber 18 is replaced twice between each combustion, however other replacement scenarios are contemplated, depending on the tool 10 and operational conditions. The value used by the control system 66 for determining the minimum recharge cycle time can be a fixed or a variable depending on the operational characteristics and application needs of the nailer. A fixed period of time, as predetermined by the tool designer, is sufficient for cases where the nailer's CFM is relatively constant throughout its use. This can be defined as CFM within ±10% of a nominal value, which can be further related to RPM of the fan motor 49, since the RPM value has a direct influence on CFM. Fan motor RPM is typically represented as current drawn or back electromotive force (emf) of the motor 49.

A variable recharge cycle is preferable for cases where CFM can fluctuate significantly during operation of the tool 10. This can occur if the motor 49 operates at different RPM levels or ranges, based on the operating mode of the tool 10. In this case, the recharge time is associated with either the motor's RPM or the firing mode. Additionally, variable CFM can occur in nailers where the motor's RPM changes in accordance with the battery's voltage. In this case, the control system 66 continually monitors the tool battery voltage or motor current, and applies minimum recharge cycle times based on predetermined values stored in the control system 66. The control system 66 monitors a specified period, known as the designated open time, in which the combustion chamber 18 is open and both the lockout device 60 and the chamber switch 44 is off. The designated open time is the period from t8 to t9.

By providing for a designated open time, the control system 66 in effect prevents subsequent tool functions, including but not limited to fuel injection and ignition, until the combustion chamber 18 has a chance to recharge. This recharge step is manifested in the retraction of the valve sleeve 36 to open the combustion chamber 18.

Between t8 and t9, "a" represents the duration of time that the recharge timer prevents initiation of other pre-combustion tool functions as discussed above, despite the closing of the chamber switch 44. This period "a" is provided for ensuring full recharge of gases in the combustion chamber 18. Note that the combustion chamber 18 is actually open for a length of time "b" extending longer than that of "a". It is contemplated that the combustion chamber 18 will be open for a time equal to or longer than the duration of the recharge timer to achieve repeatable tool performance.

Beginning at t9, the tool 10 is in preparation for the second fastener driving combustion cycle. In FIG. 3, this second sequence depicts a situation causing an insufficient purge time of the combustion chamber 18. Just prior to t10, the combustion chamber 44 is sealed, as at t2. Note that the trigger 26 remains pulled the entire time. At t10, the chamber switch 44 is closed, the fuel is injected, the lockout 60 is actuated and the mixing delay timer is initiated.

Between t10 and t11, a combustion cycle occurs similarly to that described above between t3 and t8. However, at t12, it will be seen that the combustion chamber 18 has been kept closed longer than the function provided by the chamber lockout 60 since the chamber lockout is off and the chamber switch 44 is on. This scenario is typically due to a variation in the user's behavior. Thus, the combustion chamber 18 remains closed and the recharge timer has not been actuated, even though the engine cycle is completed, and the chamber lockout 60 is released.

At t12, the user lifts the tool from the work surface, which first opens chamber switch 44, thereby initiating the recharge timer, and then opens the combustion chamber at t13. However at t14, the combustion chamber 18 is resealed, which is typically brought about by the user prematurely pressing the tool against the workpiece and closing the chamber switch 44 at t15. This can occur when moving rapidly from one worksite to another. By the relatively short duration of the period "c" from t13-t14, it will be seen that the recharge has been incomplete. Since the chamber switch 44 was closed prior to the completion of the recharge timer at period "a" (t12-t16), the normal tool functions of fuel injection, spark initiation, etc. will not be permitted by the control system 66. Thus, no combustion will occur until the purge or recharge of combustion gases has been complete. At t17, it is noted that the user releases the trigger 26, thereby discontinuing the repetitive firing mode. Thus, if the chamber open time is less than the recharge time, control system 66 is programmed such that the subsequent cycle is prevented and the user must initiate another operation, thereby opening the combustion chamber switch 44.

Figure 4:
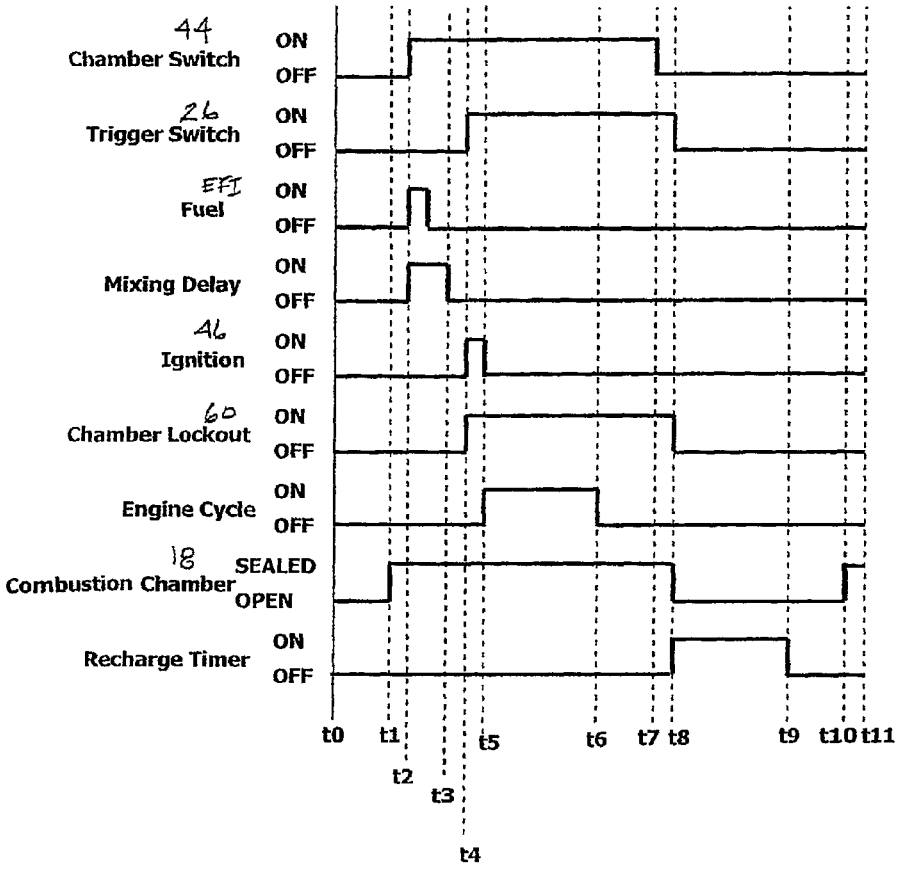
FIG. 4 is a control system timing chart illustrating the operational phases of the chamber switch, trigger switch, fuel mixing delay, ignition, chamber lockout, engine cycle, combustion chamber position and recharge timer in a fastener nailer incorporating the present control system and used for sequential firing.

Referring now to FIG. 4, an alternate embodiment of the control system depicted in FIG. 3 is presented, in which the tool 10 is designed for sequential firing. Since the operation is sequential, the chamber switch 44 will be closed before the trigger 26 is pulled, and the control system 66 is configured to prevent ignition if this sequence is not followed, as is known in the art. Although the chamber switch 44 does not detect exactly when the combustion chamber 18 makes or breaks contact with seals, it closely approximates when the chamber is sealed against, or alternatively is open to atmospheric conditions.

Thus, at t0, as before, the tool 10 is at rest. At t1, as the tool 10 is pressed against the workpiece, the valve sleeve 36 makes contact with the seals 36*a* and 36*b*, thereby sealing the combustion chamber 18. Next at t2, the chamber switch 44 is closed, indicating the tool 10 is fully actuated. As is well known in the art, closing of the chamber switch 44 initiates other tool functions such as the energization of the fan 48, injection of fuel and the initiation of the mixing delay. At t3, the mixing delay expires and the tool is ready to fire. At t4, upon pulling the trigger 26, the spark plug 46 is energized, as is the lockout device 60. While the automatic lockout is referenced, as an alternative, it is well known in the art to employ alternative mechanical lockouts.

Closing the trigger switch 26 initiates an engine combustion cycle between t5-t6, including combustion, driving the piston 22, exhaust and piston return. At t7, the chamber switch 44 opens, indicating that the tool 10 has been removed from the workpiece. At t8, the trigger 26 is released, the lockout is released, the combustion chamber 18 opens and the recharge timer starts. From t8-t9, the recharge timer, a programmed function of the control system 66, must meet a minimum required duration preset into the control system 66. Since t8-t10 indicates the actual chamber open time is longer than the recharge timer interval t8-t9, a subsequent cycling sequence is allowed by the control program 66. At t10, the combustion chamber 18 is sealed again, indicating the beginning of another cycle.

Figure 5:
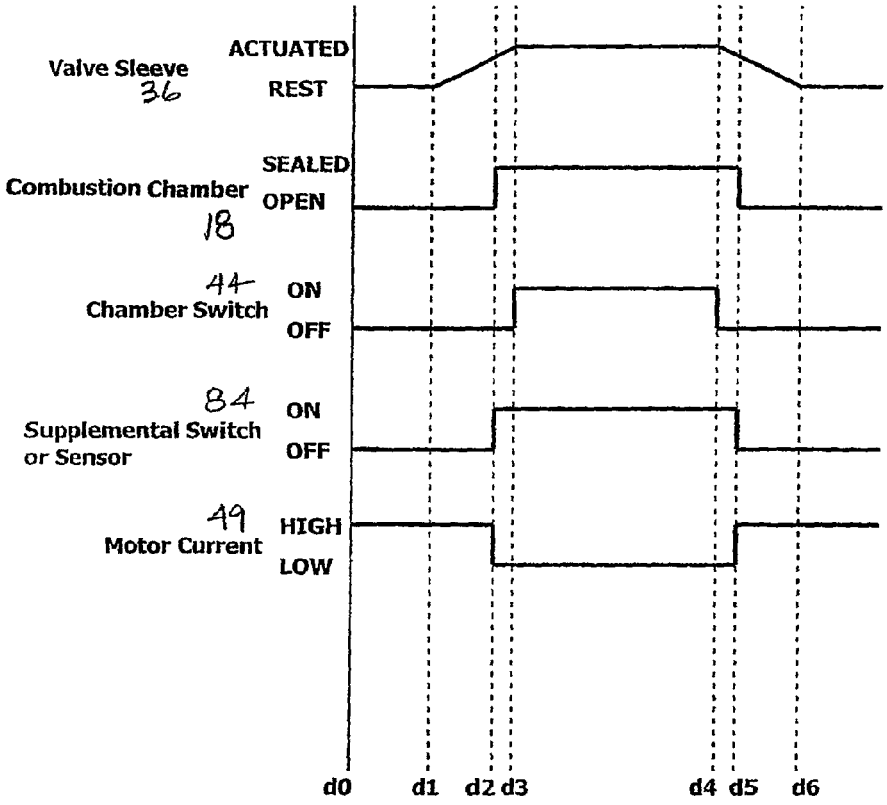
FIG. 5 is a control system timing chart for an alternate embodiment illustrating the operational phases of the valve sleeve, combustion chamber, chamber switch, supplemental switch or sensor and fan motor current.

Referring now to FIGS. 2 and 5, since the conventional chamber switch 44 is not always positioned to be an accurate indicator of the actual breaking of a seal and exposure of the combustion chamber 18 to atmospheric conditions through movement of the valve sleeve 36, it is contemplated that a supplemental switch 84 (FIG. 2) is optionally located in the housing 12 in a location where the valve sleeve is in proximity to seal contact, or at a location indicating the opening of the combustion chamber is guaranteed, such as when the tool is in the rest position as depicted in FIG. 2. As is the case with the chamber switch 44, the supplemental switch 84 is connected to the control system 66, and the time the switch 84 is open or closed may also be monitored. The supplemental switch 84 thus becomes a chamber sealing status sensor, and the chamber switch 44 remains as a conventionally considered indicator of the valve sleeve 36 as fully actuated.

As seen in FIG. 5, various tool functions are compared as to their indication of the distance or vertical displacement of the valve sleeve 36, for an indication of the status of the gases in the combustion chamber 18. First, the valve sleeve 36 is shown at d0 in a rest position as seen in FIG. 2. At d1, the valve sleeve 36 begins movement with tool actuation. Next, at d2, the valve sleeve 36 contacts the seals 36*a* and 36*b* to seal the combustion chamber 18. At d3, the valve sleeve 36 is fully actuated and the chamber switch 44 is turned on or closed. At d4, the combustion cycle is completed, and the user begins to lift the tool 10 from the workpiece, causing the chamber switch 44 to open. At d5, the combustion chamber seal 36*a* is broken and the chamber 18 is open to atmosphere. Lastly, at d6, the valve sleeve 36 is again at the rest position.

It will be seen that the supplemental switch 84 is turned on or closed at d2 upon sealing of the combustion chamber 18, and remains closed until d5 upon opening of the combustion chamber. Thus, the supplemental switch 84 is optionally monitored by the control system 66 for the length of time it is open after combustion to determine whether a proper discharge has occurred.

Alternatively, the control system 66 is optionally provided with a supplemental chamber status sensor in the form of a detector mechanism based on monitoring the current drawn by the fan motor 49 ("Motor Current" in FIG. 5). Typically, when the motor 49 is performing work such as moving air when the combustion chamber 18 is in the open position, the loads are greater and more current is drawn. Thus, the current draw is greater when the chamber 18 is open than when it is closed.

It will be seen that motor current is relatively high at d0-d2, after which time the current drops, indicating the combustion chamber 1.8 is closed. Later, at d5 and d6, once the chamber 18 reopens, the current resumes its former higher level. By monitoring the current draw of the motor 49, the control system 66 also monitors the open condition, and recharge status of the combustion chamber 18. Other suitable indicators of the open condition of the combustion chamber are contemplated.

There is benefit to use the supplemental switch 84 to provide chamber sealing status to the control system 66 during tool actuation, in addition to after firing as previously discussed. Knowing there is a time period associated for fuel delivery through a metering device, it is useful to initiate the fuel function as soon as the chamber 18 is sealed from the atmosphere, or at the moment supplemental switch 84 is ON. This provides the maximum time available for fuel and air mixing, thereby providing maximum and consistent combustion pressures.

It will be seen that the control system 66 prevents a subsequent nailer combustion-oriented operation before the combustion chamber gases have been adequately recharged. In addition, the system 66 can alternatively or in parallel disable at least one of the major tool functions, including but not limited to ignition, fuel metering or solid state switch drive circuits. Among other advantages, the present control system 66 with its recharge cycle function allows for effective nailer operation by preventing poor performance due to an insufficiently recharged combustion chamber. As such, tool resources, such as fuel, battery power and the chamber lockout apparatus are conserved. In one aspect, the tool's recharge cycle function begins when the chamber switch 44 and/or the chamber lockout 60 is off, or whichever occurs later. When provided, the supplemental switch 84 provides an accurate indication of whether or not the combustion chamber 18 is sealed, and can also initiate the recharge cycle function. Another feature of the present control system 66 is that current loads or the back emf of the fan motor 49 are used to indicate if the combustion chamber 18 is open or sealed. In such cases, the supplemental switch 84 is not needed. Also, as indicators of the position of the valve sleeve 36, such fan motor properties can be used to initiate the recharge cycle function.

While particular embodiments of the present recharge cycle function for combustion nailer has been described herein, it will be appreciated by those skilled in the art that changes and modifications may be made thereto without departing from the invention in its broader aspects and as set forth in the following claims.

What is claimed is:

1. A combustion nailer, comprising:

a tool housing;

a combustion engine substantially located within said housing and including a valve sleeve reciprocating relative to a cylinder head for cyclically opening and closing a combustion chamber;

a control system associated with said housing and connected to said combustion engine for providing for a designated open time for said combustion chamber after a combustion event and before a subsequent combustion can occur; and a lockout mechanism associated with said combustion engine for periodically retaining said valve sleeve closed, and connected to said control for remaining closed a preset period of time;

wherein said designated open time is determined based on operational status of said combustion chamber and said lockout mechanism.

2. The nailer of claim 1 wherein said control system is configured for adding said designated open time as a delay factor in a tool operational cycle, postponing subsequent combustion events.

3. The nailer of claim 1 further including a chamber switch associated with said combustion engine and configured for being activated by said reciprocating movement of said valve sleeve, and said control system is configured for adding said designated open time to an operational cycle of the tool as a timer associated with said chamber switch.

4. The nailer of claim 1 wherein said designated open time is between 50 and 150 msec.

5. The nailer of claim 1 further including a chamber switch, and a trigger switch connected to said control system so that ignition is obtained upon closing of both said trigger switch and said chamber switch.

6. The nailer of claim 5 further including a supplemental switch disposed relative to said valve sleeve to determine whether said combustion chamber is open or closed.

7. The nailer of claim 1 wherein said designated open time begins after a release of said lockout mechanism.

8. The nailer of claim 1 wherein said designated open time is variable and is based on at least one of fan motor rpm, battery voltage, motor current draw, and tool operational mode.

9. The nailer of claim 1 wherein said designated open time is fixed.

10. A combustion nailer, comprising:

a tool housing;

a combustion engine substantially located within said housing and including a valve sleeve reciprocating relative to a cylinder head for cyclically opening and closing a combustion chamber;

a chamber switch associated with said combustion engine and configured for being activated by said reciprocating movement of said valve sleeve;

a control system associated with said housing and connected to said chamber switch for providing for a designated open time for said chamber switch after a combustion event and before a subsequent combustion can occur; and a lockout mechanism associated with said combustion engine for periodically retaining said valve sleeve closed, and connected to said control system for remaining closed a preset period of time;

wherein said combustion chamber remains open for at least a duration of said designated open time while said chamber switch is deactivated, and said lockout mechanism is released.

11. The nailer of claim 10 wherein said designated open time is based on at least one of fan motor rpm, battery voltage, motor current draw, and tool operational mode.

12. The nailer of claim 11 wherein said open time is variable.

13. The nailer of claim 10 further including a supplemental switch disposed relative to said valve sleeve to determine whether said combustion chamber is open or closed.

14. A combustion nailer, comprising:

a tool housing;

a combustion engine substantially located within said housing and including a valve sleeve reciprocating relative to a cylinder head for cyclically opening and closing a combustion chamber;

a chamber switch associated with said combustion engine and configured for being activated by said reciprocating movement of said valve sleeve;

a supplemental chamber status sensor associated with said combustion engine and disposed relative to said valve sleeve to detect open and sealed positions of said combustion chamber; and a lockout mechanism associated with said combustion engine for periodically retaining said valve sleeve closed, and connected to a control system for remaining closed a present period of time, said control system configured for providing a designated open time for said combustion chamber after combustion event and before a subsequent combustion can occur;

wherein said designated open time is determined based on operational status of said combustion chamber, said chamber switch, and said lockout mechanism.

15. The nailer of claim 14, wherein said supplemental sensor is a switch activated through movement of said valve sleeve.

16. The nailer of claim 15, wherein said supplemental sensor is a control system and the status of said combustion chamber is represented by a change in fan motor current draw.

* * * * *